US012379175B2

(12) United States Patent
Lavin

(10) Patent No.: US 12,379,175 B2
(45) Date of Patent: Aug. 5, 2025

(54) HIGH-CAPACITY AUTOMATIC MAGAZINE RELOADER

(71) Applicant: Rapid Reload Technologies LLC, Lake Worth, FL (US)

(72) Inventor: Wyatt Lavin, Lake worth, FL (US)

( * ) Notice: Subject to any disclaimer, the term of this patent is extended or adjusted under 35 U.S.C. 154(b) by 0 days.

(21) Appl. No.: 18/892,850

(22) Filed: Sep. 23, 2024

(65) Prior Publication Data

US 2025/0102253 A1 Mar. 27, 2025

(51) Int. Cl.
*F41A 9/83* (2006.01)

(52) U.S. Cl.
CPC ..... *F41A 9/83* (2013.01)

(58) Field of Classification Search
CPC ..... F41A 9/83
See application file for complete search history.

(56) References Cited

U.S. PATENT DOCUMENTS 1,192,723 A * 7/1916 Zumwalt ..... F41A 9/83 42/87

* cited by examiner

*Primary Examiner* — J. Woodrow Eldred
(74) *Attorney, Agent, or Firm* — The Rapacke Law Group, P.A

(57) ABSTRACT

A high-capacity magazine reloader is disclosed, including a housing having an interior defined by a left side, a right side, a top, a bottom, a front and a back. The interior retains a plurality of rounds within a spiral channel having a first end nearmost a central axis and a second end forming an opening to permit the egress of the plurality of rounds. A spiral spring is biased to provide a rotational force to a first vertical member. A second vertical member is connected to the first vertical member via a horizontal member. The second vertical member is at least partially within the spiral channel to contact the plurality of rounds and force the plurality of rounds from the first end to the opening. A magazine receiver is positioned at the opening, the magazine receiver to releasably connect to a magazine of a firearm.

16 Claims, 2 Drawing Sheets

HIGH-CAPACITY AUTOMATIC MAGAZINE RELOADER

TECHNICAL FIELD

The embodiments disclosed herein generally relate to ammunition reloaders and more specifically to high-capacity magazine reloaders.

BACKGROUND

Firearms are designed to hold ammunition prior to being fired. Many firearms are capable of holding multiple rounds of ammunition which must be reloaded into a magazine once all the ammunition has been fired. This process can be tedious and time consuming, especially in the case of high-capacity magazines which are capable of holding a higher than normal number of ammunition rounds. For the purposes of this disclosure, a high-capacity magazine may be defined as a firearm magazine capable of holding more than 30 rounds of ammunition.

High capacity magazines are available in a number of configurations, one of which being a drum magazine. Drum magazines have a cylindrical shape and are available to the civilian and military markets. Often, drum magazines are capable of holding 100 rounds. However, other capacities are available.

To efficiently and easily reload firearms, speedloaders have been developed. Speedloaders come in various configurations depending on the type of firearm they are designed to reload. For example, speedloaders have been developed for reloading revolvers, as well as magazines used with handguns, rifles, and shotguns. However, speedloaders which are currently available are designed to load between 10-30 rounds of ammunition which is insufficient for high-capacity magazine (more than 30 rounds).

SUMMARY OF THE INVENTION

This summary is provided to introduce a variety of concepts in a simplified form that is further disclosed in the detailed description of the embodiments. This summary is not intended for determining the scope of the claimed subject matter.

The embodiments provided herein relate to a high-capacity magazine reloader, including a housing having an interior defined by a left side, a right side, a top, a bottom, a front and a back. The interior retains a plurality of rounds within a spiral channel having a first end nearmost a central axis and a second end forming an opening to permit the egress of the plurality of rounds. A spiral spring is biased to provide a rotational force to a first vertical member. A second vertical member is connected to the first vertical member via a horizontal member. The second vertical member is at least partially within the spiral channel to contact the plurality of rounds and force the plurality of rounds from the first end to the opening. A magazine receiver is positioned at the opening, the magazine receiver to releasably connect to a magazine of a firearm.

The high-capacity magazine reloader provides an efficient and easy means of quickly reloading the high-capacity magazine of a firearm. The high-capacity magazine reloader greatly reduces the time needed to reload the magazine, while reducing the tentative aspects of loading rounds into the magazine individually.

In one aspect, the horizontal member is connected to the second vertical member via a chassis having one or more wheels to allow the chassis to move along the length of the horizontal member, the chassis to allow the second vertical member to increase with the radius of the spiral channel as the plurality of rounds are forced into the magazine.

In one aspect, the high-capacity magazine reloader includes a stopper positioned to cover the opening and prevent the plurality of rounds from egressing through the opening. The stopper may be pivotally connected to the opening to allow the stopper to selectively move between an open position and a closed position. The stopper may be moved to the open position by connecting the magazine to the magazine receiver.

In one aspect, a removable pin connects to the spiral spring to prevent the spring from providing force to the plurality of rounds.

In one aspect, the high-capacity magazine reloader is reloadable.

The high-capacity magazine reloader may be used to repeatedly reload standard-capacity magazines. In such, the user can empty (such as by firing the firearm) the rounds of ammunition in a standard-capacity magazine (such as those having a capacity between 10-30 rounds), then utilize the high-capacity magazine reloader to reload the standard-capacity magazine repeatedly until the rounds within the high-capacity magazine reloader are depleted. This may be especially useful at a gun range (whether in the private setting, public setting, or military setting) by allowing users to refill their magazines using the high-capacity magazine reloader. This may also reduce waste by providing a high number of rounds within a single housing, rather than prepackaging a reloader which has the round capacity to reload a magazine once.

The high-capacity magazine reloader may be sold preloaded with rounds of ammunition. Further, it can be sold having traditional labeling on the housing, including the caliber, round count, material type, and other packaging and labelling commonly included on ammunition boxes.

The high-capacity magazine reloader may be configured to utilize nearly any caliber of ammunition and may be configured to be used with various magazine configurations including drum magazines.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1:
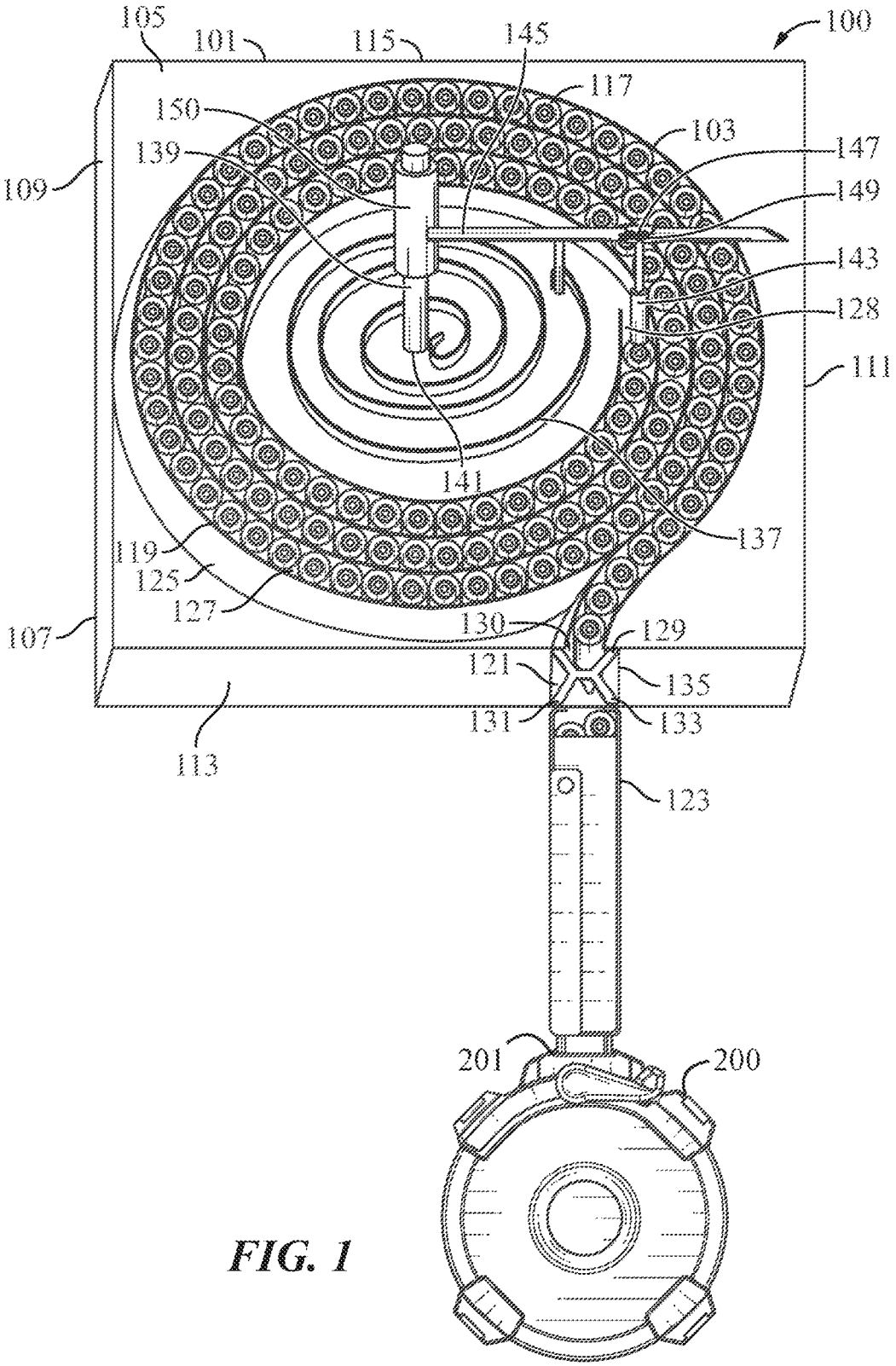
FIG. 1 illustrates a perspective view of the high-capacity magazine reloader, according to some embodiments.

The specific details of the single embodiment or variety of embodiments described herein are set forth in this application. Any specific details of the embodiments described herein are used for demonstration purposes only, and no unnecessary limitation(s) or inference(s) are to be understood or imputed therefrom.

Before describing in detail exemplary embodiments, it is noted that the embodiments reside primarily in combinations of components related to particular devices and systems.

Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments provided herein relate to a r high-capacity magazine reloader which can be used to efficiently and easily reload the high-capacity magazine of a firearm. The high-capacity magazine reloader can be provided within a box of ammunition. While the exterior of the box of ammunition may appear similar to commonly sold ammunition boxes, the box of ammunition contains the high-capacity loading mechanism described herein which efficiently and forcibly loads the ammunition into the high-capacity magazine of the firearm.

The high-capacity magazine reloader can be used in both civilian and military applications. In one example, the high-capacity magazine reloader can be provided to a gun range to allow shooters to easily and efficiently reload magazines.

While the use-case of reloading a high-capacity magazine is used by way of example herein, the high-capacity magazine reloader can also be used to reload standard magazines. In such, the high-capacity magazine reloader can be used repeatedly to reload standard magazines having a standard round capacity (e.g., those with a capacity of up to 30 rounds), so long as the rounds within the high-capacity magazine reloader are not depleted.

In some embodiments, the high-capacity magazine reloader is constructed of single-use disposable materials, such that the user may simply dispose of the housing of the high-capacity magazine reloader once the ammunition contained therein has been loaded into the magazine. Materials used to construct the ready-to-load ammunition container may be constructed of recyclable materials, compostable materials, or similar materials known in the arts.

In some embodiments, the high-capacity magazine reloader is re-usable. In such, the high-capacity magazine reloader is constructed of materials sufficient to be re-used repeatedly. In such, the user, gun range operator, etc. may reload the high-capacity magazine reloader with rounds of ammunition repeatedly as needed. This may be especially useful if the user purchases bulk ammunition which is often loosely packaged by the manufacture. In the use-case wherein the user is repeatedly loading a standard capacity magazine, the high-capacity magazine reloader eliminates the need for a speedloader.

Figure 2:
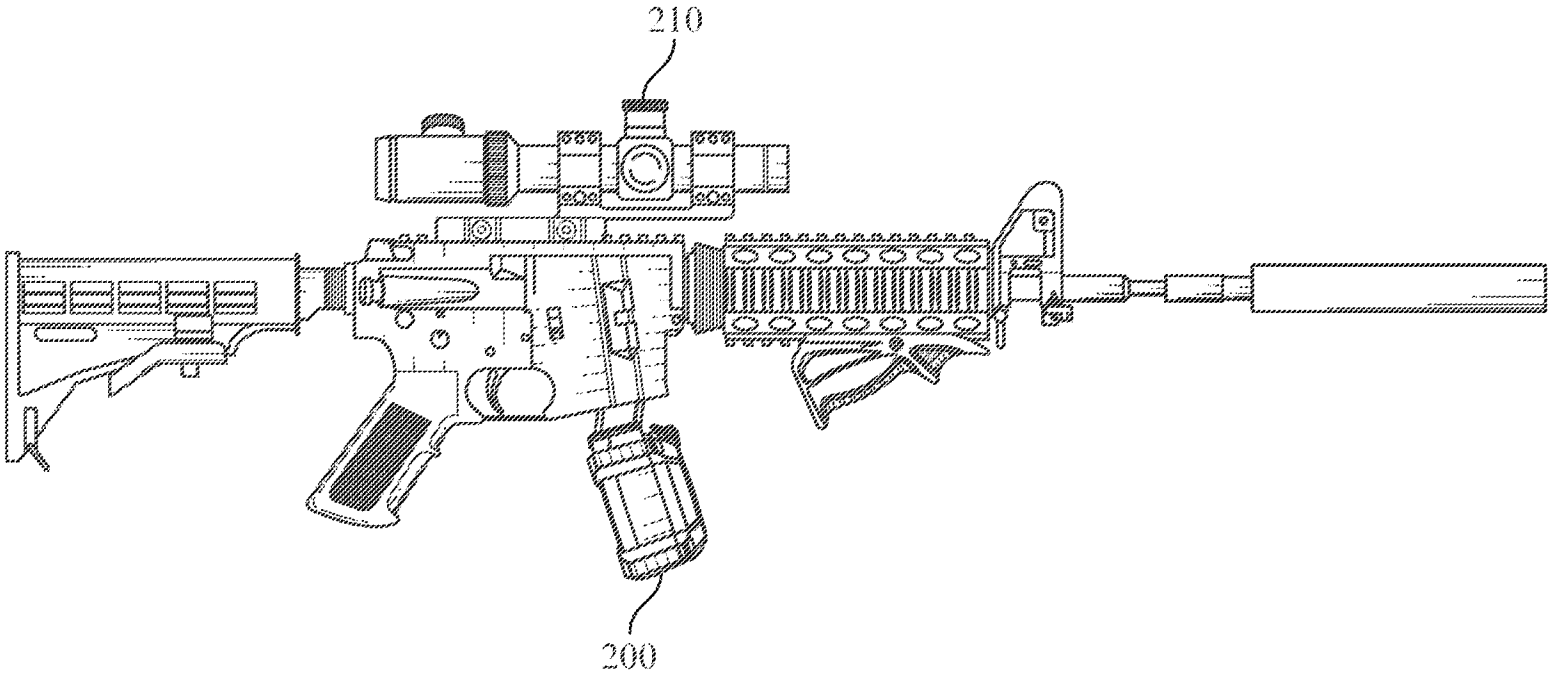
FIG. 2 illustrates a perspective view of the high-capacity magazine reloader in the process of reloading the high-capacity magazine of a firearm, according to some embodiments.

The high-capacity magazine reloader can be constructed to accept various calibers of ammunition. Further, the high-capacity magazine reloader can be configured to accept various numbers of rounds of ammunition such that various magazine sizes may be reloaded. Firearm magazines are designed to hold various amounts of ammunition. These magazines may also be stacked in different configurations (e.g., single-stack, double-stack, etc.). The present embodiments provide a ready-to-load ammunition container which can reload magazines having various capacities and configurations. Further, the high-capacity magazine reloader provides the advantage of being capable of reloading high-capacity magazines such as a drum magazine as illustrated in FIG. 2.

In some embodiments, the size and configuration of the high-capacity magazine reloader may be modified to accept various calibers of ammunition and amounts thereof without deterring from the inventive aspects described herein.

FIG. 1 illustrates the high-capacity magazine reloader 100. The high-capacity magazine reloader includes a housing 101 which can be provided within a box or other container to provide the ability for printing branding and information associated with the contents of the high-capacity magazine reloader 100. The housing 101 is constructed as a means of protecting the rounds from the elements (e.g., sun exposure, dust, moisture, etc.) which may degrade the rounds, or contaminate the rounds causing a jam or misfire of the firearm. The housing 101 includes a top 105, bottom 107, left side 109, right side 111, front 113, and back 115. The housing 101 contains a cylindrical container 103 which contains the rounds 117 therein.

The cylindrical container 103 includes a spiraled track 119 which is pre-wound by the manufacture to direct rounds through the spiraled track 119 which terminates in an opening 121, where rounds 117 pass through and into the magazine receiver 123. The spiraled track 119 allows the rounds 117 to stand vertically (or horizontally for more triangular-shaped ammunition). The spiraled track 119 forms sidewalls 125 forming a channel 127 wherein the rounds 117 travel through during reloading and are stored when the high-capacity magazine reloader 100 is not in use. The channel 127 has a first end 128 positioned nearmost the central axis 141 and a second end 130 terminating in the opening 121.

A stopper 129 is provided at the opening 121 to prevent the egress of rounds 117 when the high-capacity magazine reloader is not in-use. The stopper 129 is pivotally connected with the opening 121, such that before use, the stopper 129 can be pivoted to allow the egress of round 117 of ammunition. The stopper 129 may be pivoted to the open position once the magazine is connected to the magazine receiver 123 of the high-capacity magazine reloader 100. In the illustration of FIG. 1, the stopper is shown in the closed position 131 which prevents the rounds 117 from being ejected or otherwise egressing from the opening 121.

In some embodiments, the stopper 129 is connected to a spring 133 which biases the stopper 129 to the closed positioned.

In some embodiments, the stopper 129 includes a hinge 135 which allows the stopper 129 to pivot at the hinge 135 such that the stopper 129 selectively opens and closes via the input of the magazine.

Once the magazine (see FIG. 2) is connected to the magazine receiver 123, the rounds 117 are forcibly transmitted into the magazine of the firearm via a spiral spring 137 to provide a biased force to a first vertical member 139. The spiral spring 137 provides a torsional force to the first vertical member 139 allowing it to rotate around a central axis 141 and move a second vertical member 143 which contacts the rounds, forcing them through the channel 127. The first vertical member 139 is connected to second vertical member 143 via a horizontal member 145. The second vertical member 143 is moveably connected to the horizontal member 145 via a chassis 147 having wheels 149 to allow the second vertical member 143 to move along the length of the horizontal member 145. In such, the second vertical member 143 can travel through the spiraled channel 127 as the radius increases.

In some embodiments, to ensure the rounds 117 of ammunition do not eject undesirably, a pin may be provided to hold the tension of the spiral spring 137 when the high-capacity magazine reloader is not in-use. In this embodiments, the magazine of the firearm is connected, and the pin is then released by the user to allow for tension to be applied to the rounds 117, thus forcing the rounds 117 into the magazine.

FIG. 2 illustrates the high-capacity magazine reloader being used to reload a high-capacity magazine 200 of a firearm 210. While the example of a high-capacity magazine 200 is used, the high-capacity magazine reloader 100 can also be used with standard-capacity magazines. The magazine receiver 123 is designed to releasably engage with the upper portion 201 of the magazine 200 to form a secure fit while reloading the magazine 200. Once the magazine 200 is reloaded, the user disconnects the high-capacity magazine reloader 100 from the magazine 200.

In some embodiments, rounds 117 may be reloaded into the channel 127 of the housing 101. In this embodiment, the high-capacity magazine reloader 100 is reusable and can be refilled using bulk ammunition supplied by the user. Various methods may exist to reload the high-capacity magazine reloader 100. In one example, the user may individually slide rounds through the opening 121 and through the channel 127 until the round capacity is reached. In another example, the cylindrical container 103 may be removed when empty and replaced with a full cylindrical container 103. This full cylindrical container 103 may be pre-loaded with rounds of ammunition or may be manually loaded with ammunition by the user.

The first vertical member 139, the second vertical member 143, horizontal member 145, and spiral spring 137 may be defined as a spring assembly 150 which functions to forcibly drive the rounds 117 through the channel 127 and into the magazine.

In some embodiments, the magazine receiver 123 may include a release mechanism such that the magazine receiver 123 can be easily removed from the opening. This allows for the magazine receiver 123 to be removed and replaced depending on the type of magazine being refilled (e.g., a drum magazine, a high-capacity magazine, a handgun magazine, and rifle magazine, etc.).

In some embodiments, the high-capacity magazine reloader 100 is universal. In such, a single high-capacity magazine reloader 100 can be used to retain and reload various calibers of ammunition. In another embodiments, each high-capacity magazine reloader 100 is caliber-specific.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety to the extent allowed by applicable law and regulations. The systems and methods described herein may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

The foregoing is provided for purposes of illustrating, explaining, and describing embodiments of this disclosure. Modifications and adaptations to these embodiments will be apparent to those skilled in the art and may be made without departing from the scope or spirit of this disclosure.

As used herein and in the appended claims, the singular forms "a", "an", and "the" include plural referents unless the context clearly dictates otherwise.

It should be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

In many instances entities are described herein as being coupled to other entities. It should be understood that the terms "coupled" and "connected" (or any of their forms) are used interchangeably herein and, in both cases, are generic to the direct coupling of two entities (without any non-negligible (e.g., parasitic intervening entities) and the indirect coupling of two entities (with one or more non-negligible intervening entities). Where entities are shown as being directly coupled together or described as coupled together without description of any intervening entity, it should be understood that those entities can be indirectly coupled together as well unless the context clearly dictates otherwise.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described herein. A variety of modifications and variations are possible in light of the above teachings without departing from the following claims.

What is claimed is:

1. A high-capacity magazine reloader, comprising:

a housing defining an interior to retain a plurality of rounds;

a spiral channel having a first end nearmost a central axis and a second end forming an opening to permit the egress of the plurality of rounds;

a spring assembly to provide a rotational force to forcibly eject the plurality of rounds through the opening;

a stopper positioned to cover the opening and prevent the plurality of rounds from egressing through the opening, wherein the stopper is pivotally connected to the opening to allow the stopper to selectively move between an open position and a closed position, and wherein the stopper is moved to the open position by connecting the magazine to the magazine receiver; and a magazine receiver positioned at the opening, the magazine receiver to releasably connect to a magazine of a firearm.

2. The high-capacity magazine reloader of claim 1, wherein the spring assembly is comprised of:

a spiral spring biased to provide the rotational force to a first member; and a second member connected to the first member via a third member, the second member at least partially within the spiral channel to contact the plurality of rounds and transmit the rotational force to the plurality of rounds and eject the rounds through the opening and into the magazine of the firearm.

3. The high-capacity magazine reloader of claim 1, wherein the interior is cylindrical.

4. The high-capacity magazine reloader of claim 2, wherein the third member is connected to the second member via a chassis having one or more wheels to allow the chassis to move along the length of the third member, the chassis to allow the second member to increase with the radius of the spiral channel as the plurality of rounds are forced into the magazine.

5. The high-capacity magazine reloader of claim 1, further comprising a removable pin to connect to the spiral spring to prevent the spring from providing force to the plurality of rounds.

6. The high-capacity magazine reloader of claim 1, wherein the high-capacity magazine reloader is reloadable.

7. The high-capacity magazine reloader of claim 1, wherein the high-capacity magazine reloader is capable of reloading a magazine of any capacity.

8. A high-capacity magazine reloader, comprising:

a housing having an interior is defined by a left side, a right side, a top, a bottom, a front and a back, the interior to retain a plurality of rounds;

a spiral channel having a first end nearmost a central axis and a second end forming a selectively openable opening to permit the egress of the plurality of rounds, the opening having a closed position and an open position, wherein the closed position prevents the plurality of rounds from egressing through the opening and the open position permits the plurality of rounds from egressing through the opening;

a spiral spring biased to provide a rotational force to a first member;

a second member connected to the first member via a third member, the second member at least partially within the spiral channel to contact the plurality of rounds and force the plurality of rounds from the first end to the opening, wherein the third member is connected to the second member via a chassis having one or more wheels to allow the chassis to move along the length of the third member, the chassis to allow the second member to increase with the radius of the spiral channel as the plurality of rounds are forced into the magazine;

a removable magazine positioned at the opening, the magazine receiver to releasably connect to a magazine of a firearm, wherein the magazine receiver is removable from the opening.

9. The high-capacity magazine reloader of claim 8, wherein the interior is cylindrical.

10. The high-capacity magazine reloader of claim 8, further comprising a stopper positioned to cover the opening and prevent the plurality of rounds from egressing through the opening.

11. The high-capacity magazine reloader of claim 10, wherein the stopper is pivotally connected to the opening to allow the stopper to selectively move between an open position and a closed position.

12. The high-capacity magazine reloader of claim 11, wherein the stopper is moved to the open position by connecting the magazine to the magazine receiver.

13. The high-capacity magazine reloader of claim 8, further comprising a removable pin to connect to the spiral spring to prevent the spring from providing force to the plurality of rounds.

14. The high-capacity magazine reloader of claim 8, wherein the high-capacity magazine reloader is reloadable.

15. The high-capacity magazine reloader of claim 8, wherein the high-capacity magazine reloader is capable of reloading a magazine of any capacity.

16. A high-capacity magazine reloader, comprising:

a housing having an interior is defined by a left side, a right side, a top, a bottom, a front and a back, the interior to retain a plurality of rounds;

a spiral channel having a first end nearmost a central axis and a second end forming an opening to permit the egress of the plurality of rounds;

a spiral spring biased to provide a rotational force to a first member;

a second member connected to the first member via a horizontal third member, the second member at least partially within the spiral channel to contact the plurality of rounds and force the plurality of rounds from the first end to the opening, wherein the third member is connected to the second member via a chassis having one or more wheels to allow the chassis to move along the length of the third member, the chassis to allow the second member to increase with the radius of the spiral channel as the plurality of rounds are forced into the magazine;

a magazine receiver positioned at the opening, the magazine receiver to releasably connect to a magazine of a firearm to allow a user to perform the following:

connecting the magazine to the magazine receiver, wherein connecting the magazine opens a stopper positioned at the opening;

removing a removable pin to enable the spiral spring to forcibly eject the rounds through the opening; and disconnecting the magazine from the magazine receiver.

* * * * *